United States Patent [19]

Beran et al.

[11] Patent Number: 5,035,369

[45] Date of Patent: Jul. 30, 1991

[54] SYSTEM FOR WINDING A CONE OF YARN OR THE LIKE

[75] Inventors: Jaroslav Beran, Liberec; Miloš Pavlů Liberec; Vladimír Prásil, Liberec; Zdeněk Holý, Liberec; František Pešek, Ústí nad Orlicí; Zdeněk Vitámvás, Liberec; Josef Vitàk, Liberec, all of Czechoslovakia

[73] Assignee: Elitex koncern textilniho strojirenstvi, Czechoslovakia

[21] Appl. No.: 356,428

[22] Filed: May 24, 1989

[30] Foreign Application Priority Data

May 25, 1988 [CS] Czechoslovakia ..... 3531-88
Jun. 8. 1988 [CS] Czechoslovakia ..... 3958-88

[51] Int. Cl.[5] ..... B65H 54/42; B65H 54/46; B65H 59/38

[52] U.S. Cl. ..... 242/18 DD; 242/45

[58] Field of Search ..... 242/18 DD, 45

[56] References Cited

U.S. PATENT DOCUMENTS 4,415,125 11/1983 Schwengeler ..... 242/18 DD

FOREIGN PATENT DOCUMENTS 249338 2/1986 Czechoslovakia .
262970 5/1987 Czechoslovakia .
255131 6/1987 Czechoslovakia .
0063690 11/1982 European Pat. Off. .
0165511 12/1985 European Pat. Off. .
1912374 5/1970 Fed. Rep. of Germany .
2458853 6/1976 Fed. Rep. of Germany .
2454917 8/1976 Fed. Rep. of Germany .

*Primary Examiner*—Stanley N. Gilreath
*Attorney, Agent, or Firm*—Ostrolenk, Faber, Gerb & Soffen

[57] ABSTRACT

A system for winding filamentary material around a cone. The system includes: a drive ring for rotating the cone and a lateral ring for supporting the cone. The lateral ring is rotatable with respect to the drive ring. The angular velocity of the cone is controlled by controlling the rotation of the lateral ring responsive to the tension of the filimentary material and/or responsive to the diameter of the cone.

11 Claims, 6 Drawing Sheets

SYSTEM FOR WINDING A CONE OF YARN OR THE LIKE

BACKGROUND OF THE INVENTION

1. Field of the Invention

The invention relates to a system for winding a cone within a machine which supplies filamentary material (such as yarn or the like) to the cone at a constant speed. Preferred embodiments of the invention are directed toward a system for winding a cone around a bobbin or spool within one of a plurality of winding stations of a textile machine which supplies yarn to the cone at a constant speed.

2. Description of Related Art

Systems have been developed for winding a cone within a textile machine which supplies yarn at a constant speed. All such systems attempt to eliminate the inherent shifting of what is known as the "pure rolling point." The "pure rolling point" is the point on a common surface line between a cylindrical drive member and the cone at which the circumferential velocity of the cone is equal to the circumferential velocity of the drive member. There is no slippage between the drive member and the cone at the pure rolling point. However, slippage generally occurs along the common surface line on each side of the pure rolling point because of the different geometries of the cone and the cylindrical drive member.

A known system for winding a cone includes a drive member formed of three side-by-side rollers on a shaft. The central roller is driven by the shaft. The cone is driven exclusively by the central roller. The lateral rollers are free to turn with respect to the shaft. In spite of its simple design and advantages, this system is unsatisfactory because it cannot maintain a desired winding velocity throughout the entire winding process. Maintenance of such a desired winding velocity is important, particularly when winding a cone within an open-end spinning machine which supplies yarn at a constant speed.

In an improvement, the lateral rollers are connected to each other through a differential gear (EP 0 063 690). In this system, torque is transmitted to the cone along its entire length. Differences in circumferential velocities along the length of the cone are compensated for by the differential gear. However, even in this improved system, the pure rolling point moves along the face of the cone during winding as yarn traverses from one end of the cone to the other. This causes deviations from the desired winding velocity. Such deviations cannot be reliably compensated for. The improved system further produces poorly structured cones. Yarn loosening frequently occurs during an initial phase in which yarn is wound onto an empty tube. The differential gear does not function properly during this initial phase. Such yarn loosening may cause yarn rupture. Then, as a consequence of changes in pressure, cone hardness, and other rolling conditions, tension in the yarn drops as winding proceeds.

Other known systems attempt to solve the problems of the prior art by improving friction properties in the vicinity of the pure rolling point. However, these systems cannot eliminate displacement (or shifting) of the pure rolling point. Accordingly, these systems must be combined with other measures (such as active modification of tension within the system).

One such system (OS 262 970) features a friction zone created on a drive roller which is fixed to a drive shaft with other supporting rollers adapted to rotate freely with respect to the drive shaft. This controls the friction between the cone and the drive roller and controls displacement of the pure rolling point. Nevertheless, tension within the winding zone still fluctuates considerably during winding.

Still another known device (OS 249 338) has a roller which is fitted with an axially-movable friction ring. This system attempts to maintain the desired winding velocity by displacing the pure rolling point. However, since the roller is not divided, displacement is great, and the requirements connected with elimination of such displacement are considerable. Furthermore, the speed of the cone cannot be adequately controlled. A simple yarn intrusion behind a carrier plate, for instance, is sufficient to increase cone resistance against rotation and reduce winding velocity. Similar consequences result from untrue running of the carrier plate, tube distortion, insufficient torsional rigidity of the bobbin frame, cone vibrations, etc. The system does not keep yarn tension within required limits and has not been accepted by the industry.

To compensate for differences in fiber length, it has been proposed to drive the cone with a variable angular velocity. In this system, instead of being driven by a roller, the cone is moved parallel to its curved surface by reciprocating the driving member along the cone as illustrated in FIGS. 3 and 4 of DE-OS 2 58 853. However, this reciprocating motion causes heavy wear of the yarn. The strain increases as the amount of yarn on the cone increases because the driving member presses harder on the cone windings as the weight of the cone increases. The resulting damage makes the system unusable at high pressures. Furthermore, drive transmission efficiency is poor because of the small width of the driving member. Slippage does not permit adjustment of velocity.

In another system, displacement of the point at which the cone is driven is achieved by a plurality of supporting rollers for selectively driving the cone. This requires the driving roller to be axially displaceable within a stroke reaching from a first supporting roller at one end of the cone to a supporting roller at the other end of the cone. This large stroke exposes the driving roller to considerable wear. Further, the velocity at which the cone is driven can be changed only in discrete increments corresponding in number to the number of supporting rollers. If this number is small, the drive transmission area is very small and consequently transmission efficiency is poor.

Furthermore, the above-described systems do not take into account filament tension. Without such control, cones are wound unevenly.

Another known system (DE-PS 1 912 374) has partial rollers which are selectively connectable with a drive shaft by clutches. The clutches are controlled by a swinging arm over which the yarn is led in a loop. Dimensional changes in the loop modify the circumferential velocity of the cone. In this system, the adjustment of cone grooves to changes in yarn tension is rather rough because the total number of clutches is restricted.

Another known system (OS 255 131) has a friction clutch for disengaging a driving roller from a drive shaft upon yarn rupture and/or diminishing of the compensation length of the yarn. The drawback of this system is that the cone is driven by a single, wide member so that regulation of the pure rolling point is poor and a constant cone drive cannot be obtained.

In another known system (EP 0 165 511), a change in yarn tension in the winding zone is registered by a sensor which cooperates with a drive system. The drive system appropriately modifies the transmission ratio of an adjustable transmission gear for transmitting motion from a central drive to the cone.

The drawback of this system is the necessity of a transmission gear and a drive for each winding unit. More importantly, continuous regulation of the whole system is not possible. When there is a change in velocity ratio, it takes time (depending on the velocity of the drive system) to displace a transmission member on bevel gears. Therefore, correction of yarn tension changes beyond the permitted range occurs only by changing the velocity ratio in the transmission gear. In the meantime, the yarn tension could undergo another change calling for another modification of the velocity ratio. Due to the step-like character of the braking and starting of the rotary members of the driving roller and the resulting inertial effects, considerable fluctuation in yarn tension occurs. As a result, the quality of the completed cone and the quality of the yarn within the cone are poor.

SUMMARY OF THE INVENTION

The invention is directed to a system for winding filamentary material (such as yarn or the like) around a cone. The system includes: a drive ring for rotating the cone, a lateral ring for supporting the cone, the lateral ring being rotatable with respect to the drive ring; and means for controlling the angular velocity of the cone by controlling the rotation of the lateral ring responsive to the tension of the filamentary material and/or responsive to the diameter of the cone.

Undesirable fluctuations of yarn tension are eliminated, or substantially eliminated, or at least restricted to an acceptable range, by the invention. Thus, a cone with uniformly distributed yarn can be obtained.

Further, a mechanical means for displacing elements of a roller is not required.

The problem of zone winding is caused by synchronization between the circumferential velocity of the cone and the velocity of the yarn distributor. Zone winding does not occur if, for certain critical winding layers, such synchronization is cancelled. The known methods for cancelling synchronization are disadvantageous in that they operate without regard to the diameter of the cone being wound, producing undesirable tension fluctuations. The invention advantageously prevents zone winding by changing the velocity of one part of the roller, and by means of that are able to be applied only in the areas of the critical diameters of the winding.

Other features and objects of the invention will become apparent from the following detailed description of preferred embodiments of the invention considered in conjunction with the accompanying drawings.

DETAILED DESCRIPTION OF THE PREFERRED EMBODIMENTS

Figure 1:
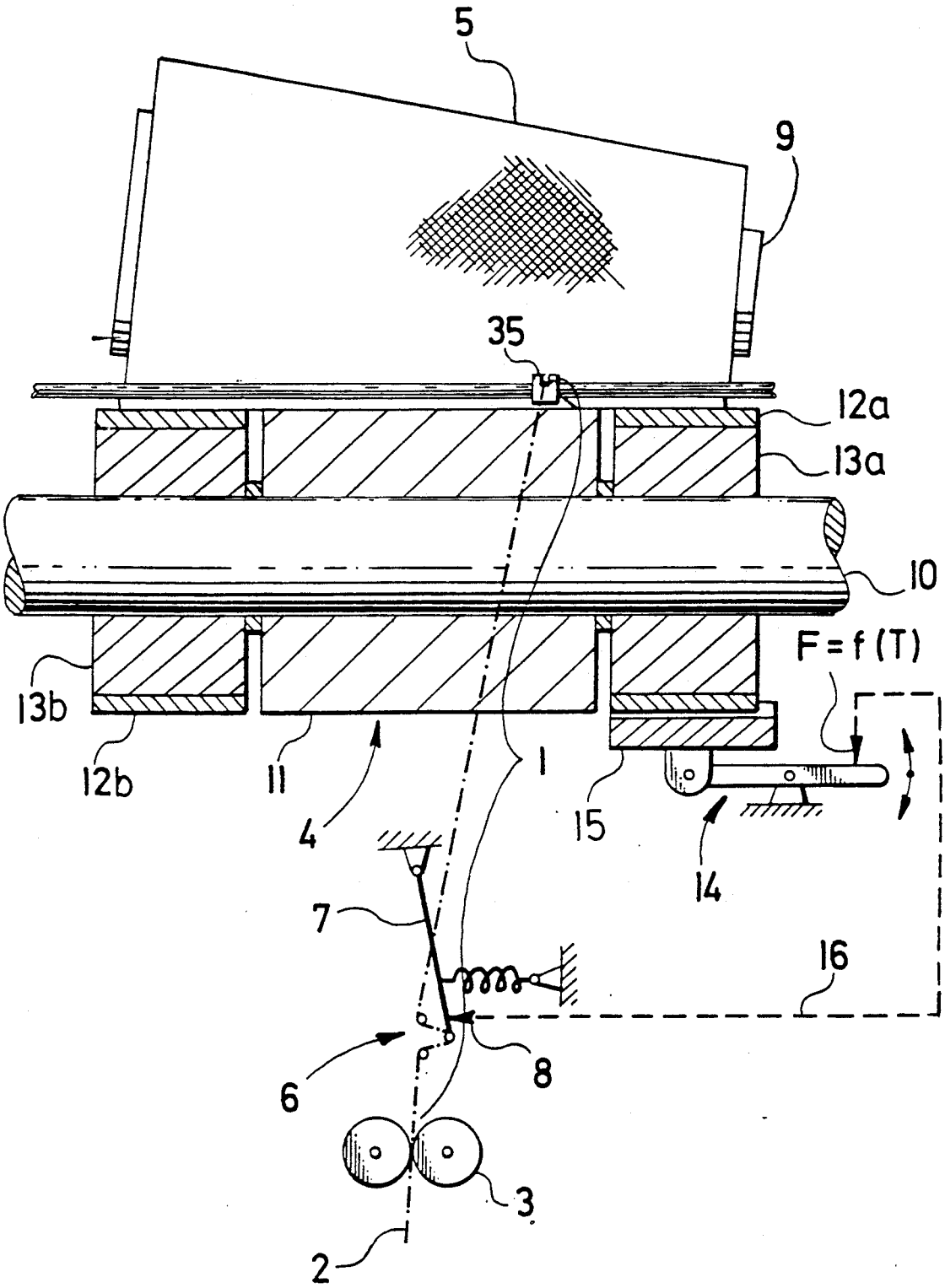
FIG. 1 is a partially cross-sectional and schematic front view of a first preferred embodiment of the invention.

As illustrated in FIG. 1, a winding zone 1 of yarn 2 or other filamentary material is situated between take-up rollers 3 and a roller 4 for rotating a cone 5.

A first regulation system 6 is situated in the winding zone 1. The regulation system 6 includes a rotatable or swinging feeler 7 for compensating for fluctuations or changes in the tension T (not illustrated) within the yarn 2. The feeler 7 can be used independently or, alternatively, in combination with a sensor 8.

The roller 4 supports the cone 5 along its entire length and drives the cone 5 (or a tube 9 at the start of winding). The roller 4 includes a drive ring 11 and two lateral rings **12*a* and 12*b*. The rings 11, 12*a*, and 12*b* are mounted side-by-side on a drive shaft 10. The drive shaft 10 rotates the ring 11. The lateral rings 12*a* and 12*b* are mounted on the drive shaft 10 by bearings 13*a* and 13*b* so that the rings 12*a* and 12*b* turn freely on the drive shaft 10**.

The pure rolling point, i.e., the point at which slippage between the drive ring 11 and the cone 5 is equal to zero is located on a common surface line between the drive ring 11 and the curved surface of the cone 5 (or of the tube 9). A certain amount of slippage occurs at all other points along the common surface line in the vicinity of the pure rolling point. Because of the geometry of the cone 5 and the ring 11, the angular velocity of the cone 5 is a function of the position of the pure rolling point.

Cooperating with the first regulation system 6 is a second regulation system 14 associated with the ring **12*a*. The regulation system 14 includes a brake 15 which is connected to the first regulation system 6 through a connection system (illustrated schematically at 16**).

The tension T is registered by the feeler 7 and, if desired, the sensor 8. As the tension T within the yarn 2 fluctuates, the ring **12*a* is braked and released, and the position of the pure rolling point is displaced along the common surface line. As a result, the angular velocity of the cone 5** is a function of the tension T.

The angular velocity of the ring **12*a* is continuously controlled as a function of the tension T. As a result, the pure rolling point is continuously displaced as necessary to maintain the circumferential velocity of the cone 5 at a constant desired velocity as the cone 5** increases in diameter during winding.

Figure 2:
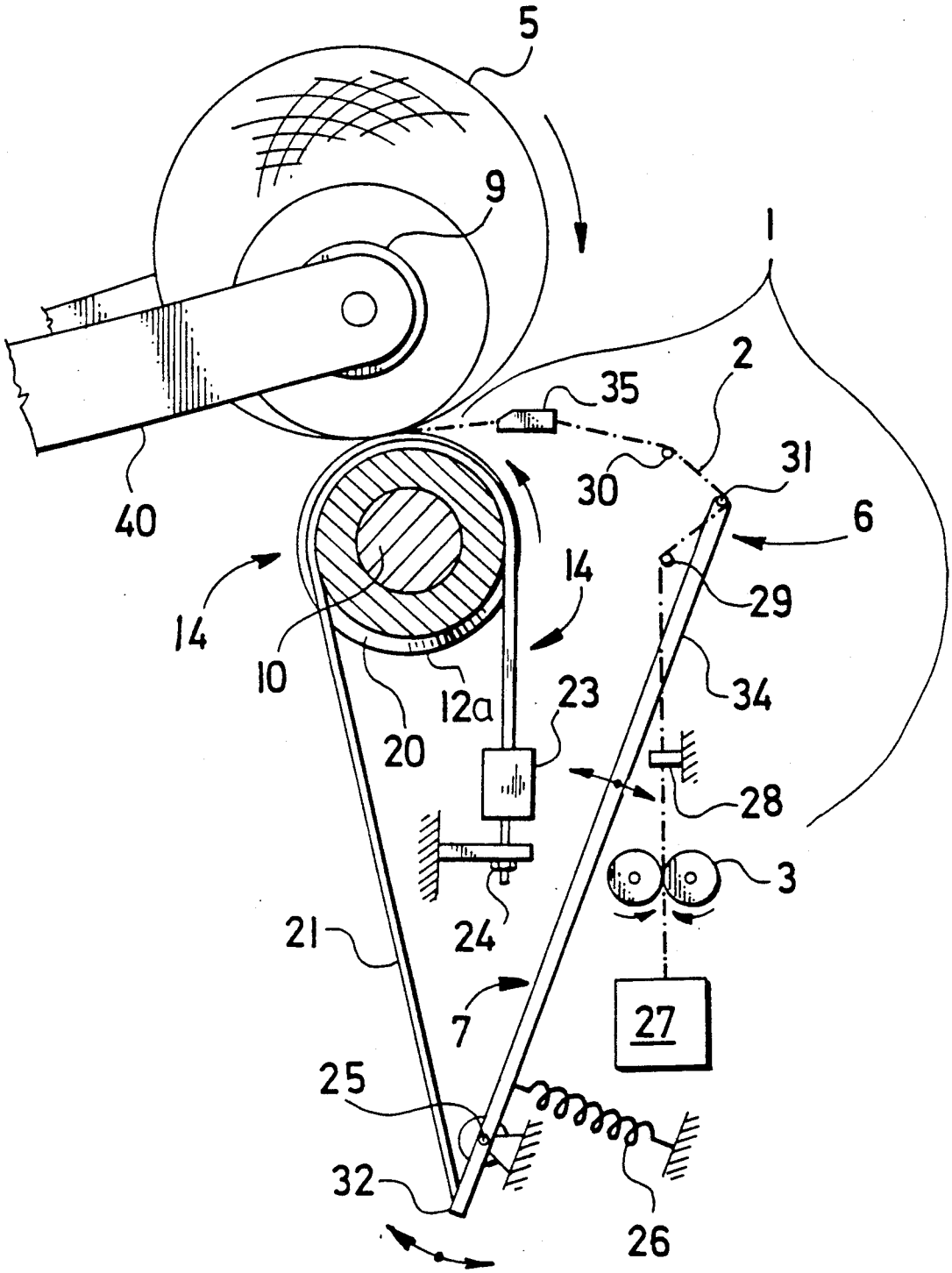
FIG. 2 is a partially cross-sectional side view of the first embodiment of the invention.
Figure 3:
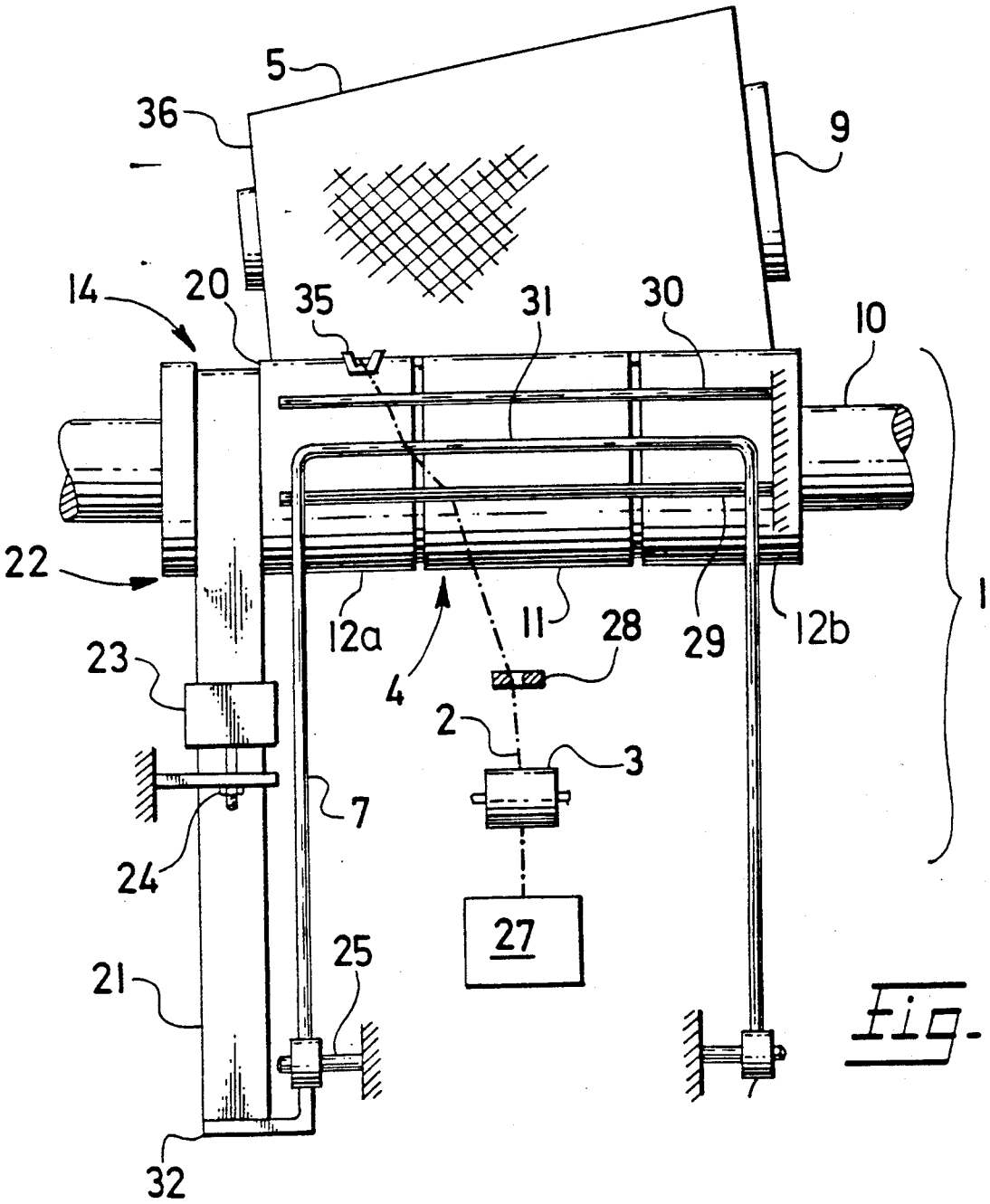
FIG. 3 is a front view of the first preferred embodiment of the invention.

Referring to FIGS. 2 and 3, the ring **12*a* has a groove 20. The brake of the second regulation system 14 includes a strap 21 which is inserted into the groove 20. One end of the strap 21 is fixed to an adjustment member 23 which is controlled by an adjusting screw 24. The other end of the strap 21 is fixed to a lower section 32 of the rotatable feeler 7. The feeler 7 is rotatable about a fulcrum 25 and cooperates with a tension spring 26**.

The yarn 2 (produced by a spinning unit 27 of an open-end spinning machine) is taken-up by the take-up rollers 3, passes across guide members 28, 29, and 30, and is fed into a distributor 35 which distributes the yarn 2 along the width of the cone 5.

A compensation section 31 of the feeler 7 is in contact with the yarn 2 between the guide members 29 and 30. The section 31 is biased by the spring 26 in a clockwise direction (as viewed in FIG. 2) to take up slack in the yarn 2.

The embodiment illustrated in FIGS. 2 and 3 operates as follows: The compensation section 31 moves as a function of the tension T in the winding zone 1. If the tension T is reduced, the yarn 2 slackens and the compensation section 31 is moved by the spring 26 to the right (as viewed in FIG. 2) and the lower section 32 of the feeler 7 moves to the left. This releases the strap 21 and reduces the frictional resisting force between the strap 21 and the groove 20. Since the ring 12*a* is in contact with the cone 5, the angular velocity of the ring 12*a* increases as the resisting force decreases. This causes the pure rolling point to move toward the small end 36 (FIG. 3) of the cone 5. Thus, the circumferential velocity of the cone 5 increases, achieving a corresponding modification of the ratio between the winding velocity and the take-up velocity. In this way, the tension T increases. The ensuing feedback continuously regulates the tension T and maintains its desired value throughout the winding of the cone 5. As a result, windings do not become loosened as the diameter of the cone 5 increases.

The resisting force can be adjusted by the adjusting member 23. This can be advantageous when there is a substantial change in the yarn count.

Further, an end section 34 of the feeler 7 can be more flexible than the lower section 32 so that the lower section 32 does not move until the section 34 has moved a certain extent. This provides stability for the brake 15.

The "pure rolling point" moves toward the small end of cone 5 when the circumferential velocity of the cone 5 is increased, upon reduction of the frictional force of strap 21, for several reasons.

In the course of winding, the balanced state, at which the mean circumferential speed of the cone corresponds to the velocity of yarn feed, begins slowly to change. In the balanced state, the pure rolling point is situated somewhere within the width of center ring 11. When the tractive force in the yarn in the winding zone 1 is reduced, the frictional force of strap 21 is also reduced. Thus, the ring 12*a*, which is braked by said strap 21 and is freely rotatable, can be rotated more freely by friction from the package 5 and, correspondingly, package 5 is braked less or is not braked at all by said ring.

Thus package 5 begins to rotate at a higher speed, and the imaginary pure rolling point is displaced in the direction toward the small end of package 5, as a substantial change of transmission takes place between the entrained center ring 11 of roller 4, and the corresponding section of package 5. At that moment, the tractive force in yarn 2 in the winding zone 1 increases again, until the balanced state is reached, at which time the "pure rolling point" returns to its original position, more or less precisely.

The pure rolling point cannot be, either theoretically or practically, displaced as far as the freely rotatable ring 12*a*, because the package would not rotate.

During the winding of the package from the initial to the final state, i.e. the full package, the package is acted upon by several different factors, e.g. the increasing weight of the package, the non-linear relieving of the bobbin frame, and also the increasing diameter of the package, reducing the crossing angle of the individual yarn winds. The constant reduction of the crossing angle causes the winding on of less yarn. It is also known, that the pure rolling point is spontaneously displaced towards the large end of the cone, whereby the winding speed is also reduced. All this must be compensated. The speed of rotation of the entrained ring must be tuned up in such manner that the package is always rotated at such speed, that no permanent reduction of the winding speed takes place, even in the most adverse case, i.e. when the pure rolling point would be situated at the edge of the entrained ring 11, adjacent the outer lateral freely rotatable ring 12*b*. The braking of the package rotation, which is an adverse influence upon the package, is kept under control by the disclosed system. As already mentioned above, the pure rolling point can be displaced only within the width of the entrained ring 11.

Figure 4:
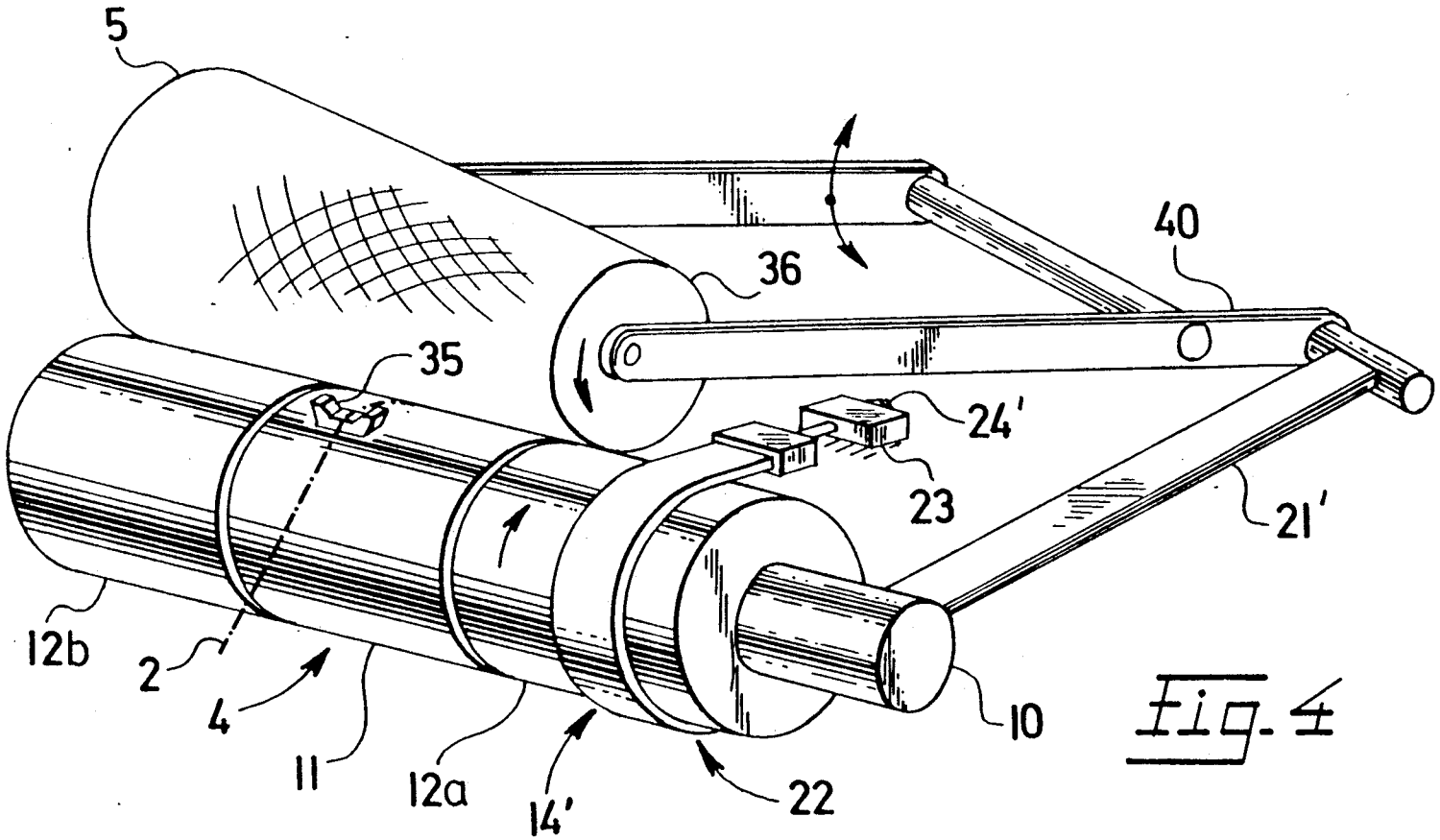
FIG. 4 is a perspective view of a second preferred embodiment of the invention.
Figure 5:
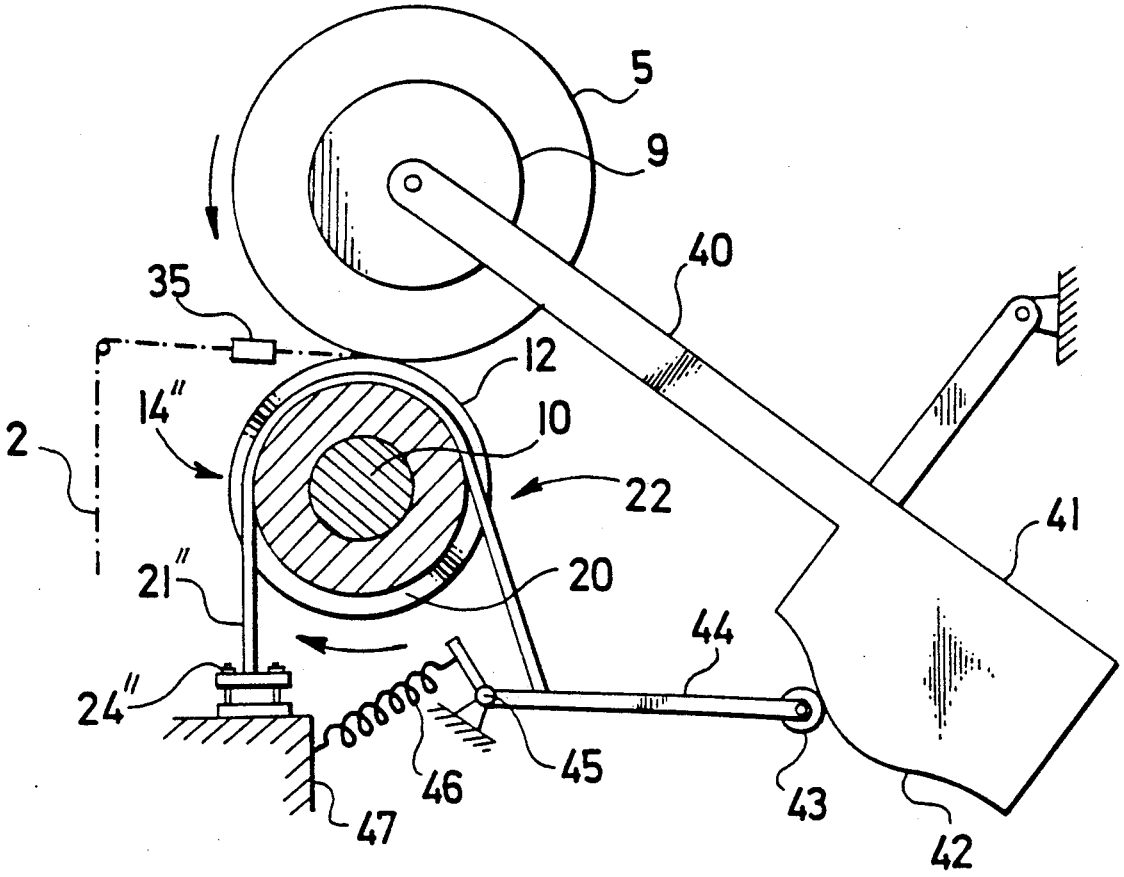
FIG. 5 is a cross-sectional side view of a third preferred embodiment of the invention.
Figure 6:
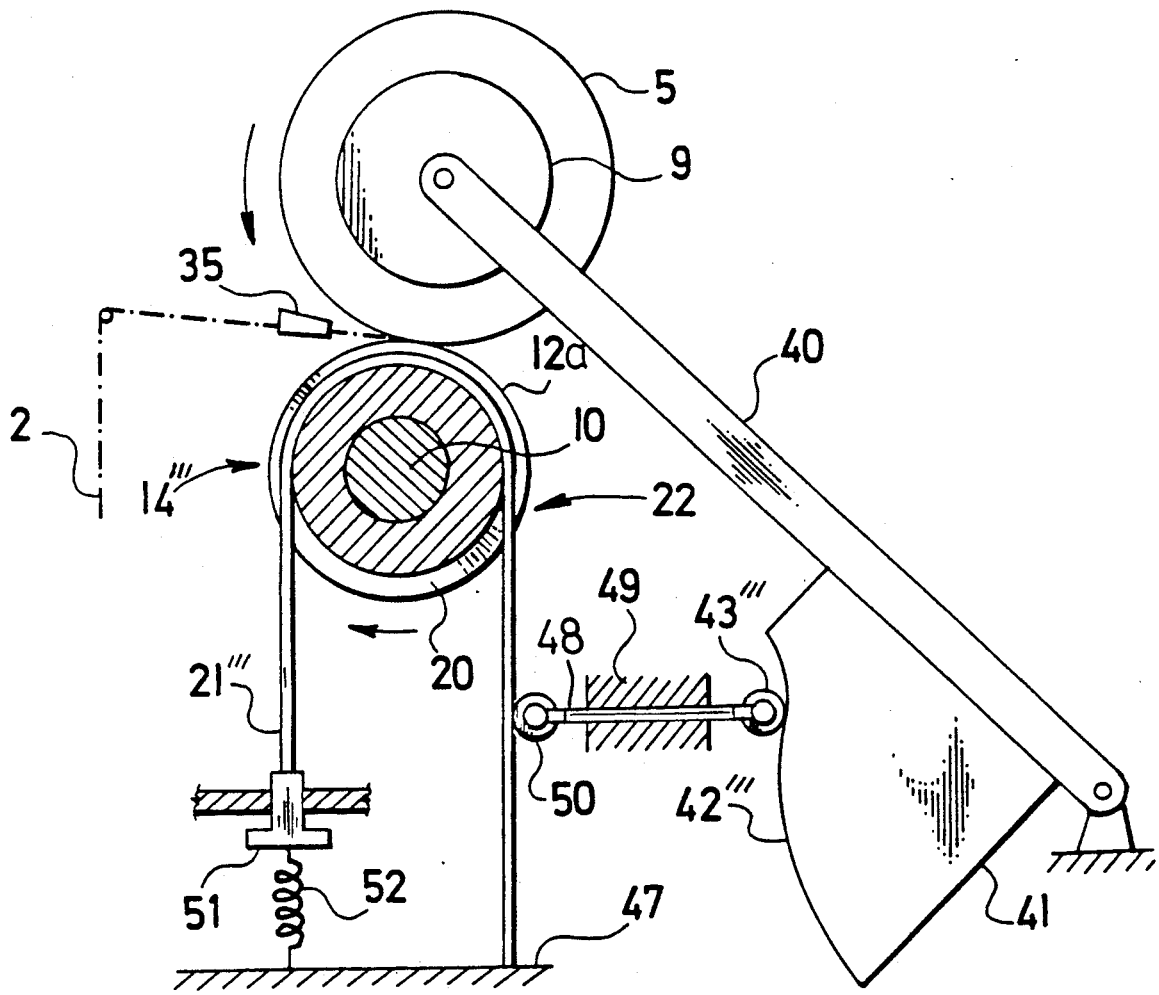
FIG. 6 is a cross-sectional side view of a fourth preferred embodiment of the invention.

The embodiments of the invention illustrated in FIGS. 4–6 have many features in common with the embodiments illustrated in FIGS. 1–3. Features which are not identical to each other but which are functionally related are distinguished from each other by one or more primes (').

In the embodiment illustrated in FIG. 4, a strap 21' of a brake of a regulation system 14' passes over the groove of the ring 12*a*. One end of the strap 21' is fixed to a rotatable bobbin frame 40. The other end of the strap 21' is fixed to an adjustment member 23' which has an adjusting screw 24' for adjusting the tension of the strap 21' prior to winding. As the diameter of the cone 5 increases, the bobbin frame 40 rotates in a clockwise direction (as viewed in FIG. 4) which loosens the strap 21' with respect to the ring 12*a*. This reduces the resisting force of the regulation system 14'. As a result, the desired circumferential velocity of the cone 5 is maintained. That is, reducing the resisting force increases the angular velocity of the ring 12*a*, which is in contact with and rotated by the small end 36 of the cone 5. The pure rolling point is displaced toward the small end 36 with an ensuing increase in the angular velocity of the cone 5 resulting in the required correction of the tension T. Thus, an increase in the diameter of the cone 5 does not cause windings to loosen as would otherwise occur (due to a decrease in the tension T). Of course, displacement of the pure rolling point takes place only within the width of the drive ring 11 of the roller 4.

In the embodiment illustrated in FIG. 5, a control member 41 is fixed to the rotatable bobbin frame 40. The control member 41 has a cam 42. A roller 43 contacts and follows the cam 42. The roller 43 is connected to a lever 44 which is rotatable about a fulcrum 45. A tension spring 46 connects the other end of the lever 44 to a stationary section 47. A strap 21'' is connected to the lever 44 and passes over the groove 20 of the ring 12*a* to resist the rotation of the ring 12*a*. The other end of the strap 21'' is adjustably connected to the stationary section 47. The tension of the strap 21'' can be adjusted prior to winding by adjusting a winding screw 24''.

In the embodiment illustrated in FIG. 6, a roller 43''' for following a cam 42''' is connected to a bar 48 which passes through a guide 49. A roller 50 connected to the other end of the bar 48 is in contact with a strap 21''' of a a second regulation system 14'''. The strap 21''' is wrapped over the groove 20 of the ring 12*a* to resist the rotation of the ring 12*a*. One end of the strap 21''' is fixed to the stationary section 47 and the other end is fixed to a stop 51. The stop 51 is in turn connected to a tension spring 52 which is connected to the stationary section 47. The roller 50 increases the tension of the strap 21''' by pushing against the strap 21'''. Prior to winding, the tension of the spring 52 can be adjusted to adjust the tension of the strap 21'''.

In the embodiments illustrated in FIGS. 5 and 6, the variable tension of the straps 21'' and 21''' is defined by the shape of the cams 42 and 42'''. Thus, the force for resisting the rotation of the ring 12*a* changes (increases or decreases) as winding proceeds (as the diameter of the cone 5 increases). In this way, displacement of the pure rolling point toward the small end 36 (or toward the larger flange) can be pre-programmed by appropriately shaping the cams according to the tension desired during different winding stages.

Tests conducted according to textile industry standards have shown that the embodiment of FIG. 1 can maintain a winding velocity of 140 m/min while winding a high quality cone with an angle of conicity of 4°20' with the diameter of the large flange increasing from 65 to 300 mm.

In the embodiment of FIG. 5, under the same conditions, three predetermined tension functions for controlling the tension T in the yarn 2 have been maintained. Two of these functions were decreasing and one of them was slightly increasing, with respect to the increasing diameter of the large flange of the cone 5. The wound cones were all of high quality.

Although the present invention has been described in relation to particular embodiments thereof, many other variations, modifications, and other uses will become apparent to those skilled in the art. It is preferred, therefore, that the present invention be limited not by the specific disclosure herein, but only by the appended claims.

What is claimed is:

1. A system for winding filamentary material around a cone, said system comprising:

a drive ring for rotating the cone;

a lateral ring for supporting the cone, said lateral ring being rotatable with respect to said drive ring; and controlling means for controlling the angular velocity of the cone by sensing the tension of the filamentary material and controlling the rotation of said lateral ring in response to the tension of the filamentary material.

2. The system of claim 1, further comprising means for supplying the filamentary material to the cone at a constant speed.

3. The system of claim 1, wherein said controlling means includes means for maintaining the circumferential velocity of the cone at a desired circumferential velocity.

4. The system of claim 3, wherein said controlling means includes:

sensing means for sensing the tension of the filamentary material; and a brake for applying a resisting force to resist the rotation of said lateral ring, said brake being operatively connected to said sensing means so that the resisting force applied by said brake increases as the tension of the filamentary material increases and so that the resisting force applied by said brake decreases as the tension of the filamentary material decreases.

5. The system of claim 4, wherein:

said sensing means includes a feeler which is adapted to rotate in response to changes in the tension of the filamentary material; and said brake includes a strap which is wrapped around said lateral ring to apply the resisting force, one end of said strap being operatively connected to a first end of said feeler so that the tension of said strap and the resisting force applied by said brake increase as the tension of the filamentary material increases and so that the tension of said strap and the resisting force applied by said brake decrease as the tension of the filamentary material decreases.

6. The system of claim 5, further comprising guides for guiding the filamentary material, said feeler including a second end for contacting the filamentary material between said guides.

7. The system of claim 6, wherein:

said feeler includes a stationary fulcrum and a tension spring for biasing said second end toward the filamentary material; and said strap includes means for adjusting the length of said strap to adjust the resisting force of said brake.

8. The system of claim 5, wherein said second end of said feeler is more flexible than said first end whereby the resisting force applied by said brake is stabilized.

9. The system of claim 1, further comprising a drive shaft for rotating said drive ring and for supporting said lateral ring.

10. The system of claim 9, further comprising:

a third ring for supporting the cone, said third ring being supported by said drive shaft, said third ring being rotatable with respect to said drive ring, said drive ring being located between said lateral ring and said third ring, said lateral ring, said drive ring, and said third ring being adapted to support the entire length of the cone.

11. The system of claim 1, wherein the filamentary material is yarn.

* * * * *